United States Patent [19]

Emenaker

[11] 3,979,999

[45]*Sept. 14, 1976

[54] FLUID CYLINDER HAVING SELF-LOCKING MEANS

[75] Inventor: Richard G. Emenaker, Romeo, Mich.

[73] Assignees: Harry S. Nichols, Jr., Troy; Karen (Emenaker) Powers, Leonard, both of Mich. ; part interest to each

[ * ] Notice: The portion of the term of this patent subsequent to May 15, 1990, has been disclaimed.

[22] Filed: Oct. 30, 1972

[21] Appl. No.: 302,341

Related U.S. Application Data

[62] Division of Ser. No. 114,575, Feb. 11, 1971, Pat. No. 3,732,783.

[52] U.S. Cl. ..... 91/44; 92/17; 92/33; 92/165 PR

[51] Int. Cl.[2] ..... F15B 15/26

[58] Field of Search ..... 92/17, 15, 28, 33; 91/44, 45, 41

[56] References Cited

UNITED STATES PATENTS

| | | | |
|---|---|---|---|
| 679,421 | 7/1901 | Halsey | 92/17 |
| 1,783,359 | 12/1930 | Floyd | 92/17 |
| 2,660,028 | 11/1953 | Geyer | 91/45 |
| 2,688,227 | 9/1954 | Geyer | 92/17 |
| 2,730,994 | 1/1956 | Light | 92/17 |
| 2,859,734 | 11/1958 | Elmer et al. | 91/45 |
| 2,875,980 | 3/1959 | Grace | 92/17 |
| 2,918,786 | 12/1959 | Geyer | 91/45 |
| 2,960,069 | 11/1960 | Geyer | 92/17 |
| 3,218,937 | 11/1965 | Dettlof | 92/33 |
| 3,550,731 | 12/1970 | Roselius | 91/41 |
| 3,785,249 | 1/1974 | Piroska | 91/41 |

*Primary Examiner*—Paul E. Maslousky
*Attorney, Agent, or Firm*—Basile and Weintraub

[57] ABSTRACT

A fluid cylinder having a tubular housing with a piston reciprocably mounted therein and capable of fluid pressure actuation in opposite directions. One side of the piston carries an actuating rod which slidably extends through one end of the tubular housing, while a coaxially aligned bore extending from the opposite side of the piston and into the actuating rod has a threaded surface adapted to receive a threaded member which, in turn, is rotatably carried at the other end of the tubular housing. The threaded surfaces of the piston bore and the rotatable threaded member engage in a self-locking relationship such that the piston is incapable of movement when subjected to fluid pressure unless the threaded member is initially and continually rotated. Means are provided for selectively rotating the threaded member upon fluid pressure actuation of the piston in either direction.

7 Claims, 3 Drawing Figures

FLUID CYLINDER HAVING SELF-LOCKING MEANS

This is a divisional of application Ser. No. 114,575, filed Feb. 11, 1971, now U.S. Pat. No. 3,732,783.

BACKGROUND OF THE INVENTION

1. Field of the Invention

The present invention relates to fluid pressure operated actuators and particularly to a linear fluid cylinder actuator having self-locking means.

2. Description of the Prior Art

Heretofore in the design of fluid systems, numerous mechanisms have been employed to prevent the movement of a piston within a fluid cylinder in the event of a failure in the fluid system. One such system employs complicated valving mechanisms and circuitry which are adapted to prevent the exhausting of fluid from that side of the piston which is opposing the external load. Although such systems have functioned in an acceptable manner, resistance to the movement of the piston, and thus to the external load, in such systems diminishes with increasing use as the valves employed in the systems tend to develop volumetric losses that may go undetected, and which eventually will result in movement of the piston. In other situations when the system failure is due to a faulty piston seal, that is, fluid leakage occurring directly between the opposite sides of the piston within the fluid cylinder, most valve systems are completely useless, and the piston will be moved by the load. In many applications this movement may not only result in damage to the fluid cylinder and the equipment being operated on, but may cause injury to the operator of the fluid cylinder, as for example when such fluid cylinders are employed for use on a hoist.

Other mechanisms have been employed in combination with fluid cylinders in order to control the movement of the piston within the fluid cylinder. One such mechanism comprises a fluid cylinder having a reciprocably mounted piston with an actuating rod extending from one end, while the other end of the piston has a threaded bore adapted to receive a threaded rotating member. The other end of the rotating member extends externally of the fluid cylinder and is adapted to be engaged by a suitable locking device to prevent relative rotation between the member and the piston. When the threaded member is restrained against rotation, the piston, which likewise is restrained from rotation, is incapable of movement in an axial direction. Such prior art systems have the same disadvantages as the aforementioned fluid systems in that they are dependent upon an external locking means and an external source of power to initiate and maintain restrainment in the movement of the piston when an external load is applied to the piston.

SUMMARY OF THE INVENTION

The present invention, which will be described subsequently in greater detail, comprises a fluid cylinder having a piston reciprocably mounted therein for axial movement in response to fluid pressure actuation, the piston having a threaded bore receiving a rotatably mounted threaded member with the engaged surfaces of the piston bore and threaded member being in a self-locking relationship such that the piston is non-reciprocal when subjected to fluid pressure unless said threaded member is simultaneously rotated in said piston bore.

It is therefore an object of the present invention to provide a fluid cylinder having a piston adapted to be selectively restrained from reciprocal movement at any point in its stroke.

It is a further object of the present invention to provide a fluid cylinder having self-locking means for automatically stopping the movement of the cylinder piston in the event of a system failure, which locking means are also adapted to function as a back-up system for driving said piston.

It is a further object of the present invention to provide a fluid cylinder having locking means which function without the need for an external source of power.

Other objects, advantages, and applications of the present invention will become apparent to those skilled in the art of fluid cylinders when the accompanying description of a preferred embodiment for practicing the invention is read in conjunction with the accompanying drawing.

BRIEF DESCRIPTION OF THE DRAWING

The description herein makes reference to the accompanying drawing wherein like reference numerals refer to like parts throughout the several views, and in which.

DESCRIPTION OF THE PREFERRED EMBODIMENT

Figure 1:
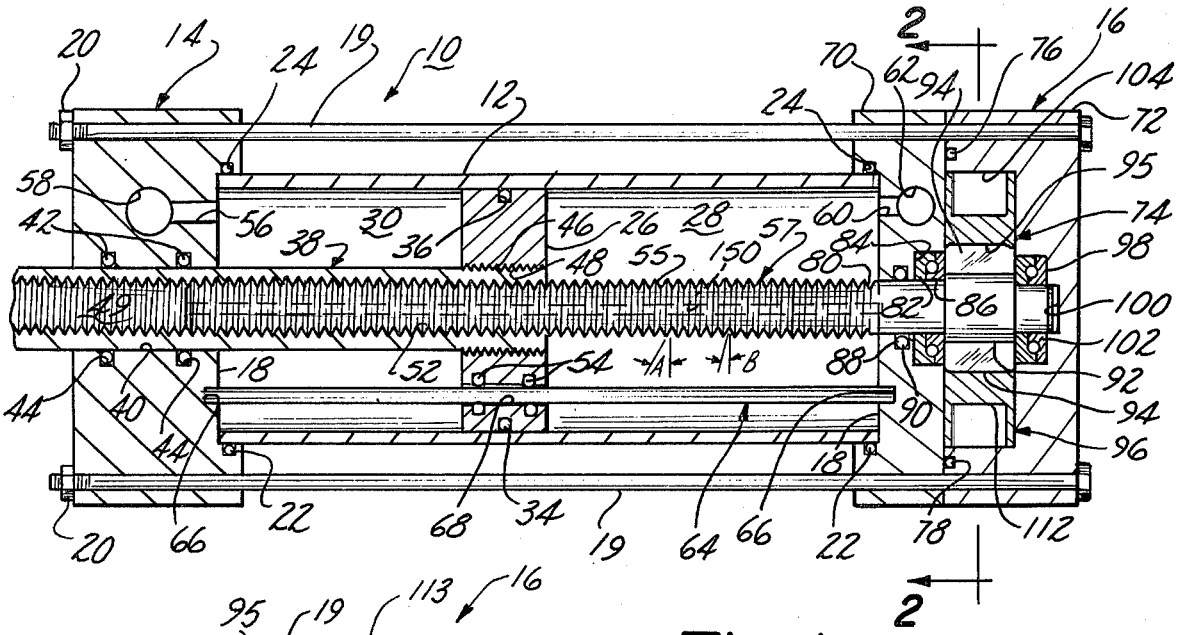
FIG. 1 is a longitudinal cross-sectional view of a fluid cylinder incorporating the inventive principles of the present invention.

Referring to FIG. 1, a fluid cylinder 10 is illustrated as comprising a tubular housing 12 enclosed at its opposite ends by end covers 14 and 16, each of which have recesses 18 which receive the opposite ends of the tubular housing 12. The end covers 14 and 16 are secured to the tubular housing 12 by a plurality of elongated bolts 19 which extend through the end covers 14 and 16 to engage nuts 20. Conventional O-rings 22 are provided in annular recesses 24 at the juncture of the end covers with the outer peripheral surface of the tubular housing 12 to provide a suitable seal.

The fluid cylinder 10 has a piston 26 reciprocally mounted within the tubular housing 12, the piston 26 dividing the interior of the tubular housing into an extending chamber 28 and a retracting chamber 30. The piston 26 includes a suitable sealing means, such as an O-ring 34, disposed in an annular recess 36 extending around the outer periphery of the piston 26 for sliding engagement with the inner surface of the tubular housing 12. The piston 26 is further provided with a hollow actuating rod 38, enclosed at its outer end (not shown), and which extends from one side of the piston 26 through a bore 40 in the end cover 14 for connection at its outer end to a movable load (not shown). The actuating rod 38 is adapted to be reciprocated with the piston 26 along the axis of the tubular housing 12 in a manner to be described in greater detail hereinafter. O-rings 42, disposed in annular recesses 44 formed in the end cover bore 40, provide a suitable seal to prevent the leakage of fluid from the retracting chamber 30. The actuating rod 38 has a threaded inner end 46 which engages a centrally disposed threaded bore 48 in piston 26 to provide a suitable attachment of the rod 38 to piston 26, however, other attaching means, such as a press-fit or welding, may be employed to attach the rod 38 to the piston.

A portion of the interior 49 of the hollow actuating rod 38 has a threaded surface 52 commencing from the extending chamber end of the actuating rod 38 and terminating at the enclosed end of rod 38 or at some selected distance therefrom. The threaded surface 52 of the actuating rod 38 is engaged by a mating threaded portion 55 of a rotatably mounted shaft 57. The shaft 57 has a length approximately equal to the length of the tubular housing 12, while the threaded portion 55 extends substantially the full length of the shaft 57. The interior 49 of the actuating rod 38 amy be vented back to the extending chamber 28 by any suitable means, such as axial and radial bores 150 extending through shaft 57.

The retracting chamber 30 is adapted to be selectively connected to a source of fluid pressure or a fluid reservoir through a passageway 56 and a fluid port 58, both of which are located in the end cover 14, while the extending chamber 28 is adapted to be selectively connected to a source of pressure or a fluid reservoir through a passageway 60 and a fluid port 62, both of which are located in the end cover 16. Pressurization of the retracting chamber 30 generates a force on the piston 26 which tends to move the same rightwardly, as viewed in FIG. 1, while fluid is exhausted from the extending chamber 28; pressurization of the extending chamber 28 generates a force on the piston 26 which tends to move the same leftwardly, as viewed in FIG. 1, while fluid is exhausted from the retracting chamber 30.

Still referring to FIG. 1, the fluid cylinder 10 is further provided with an elongated rod 64 engaged at is opposite ends within apertures 66 formed in the interior walls of the end covers 14 and 16, the rod 64 extending through an axial bore 68 in the piston 26. The rod 64 permits the piston 26 to reciprocate in an axial direction within the tubular housing 12, while restraining the piston 26 from rotation about the longitudinal axis of the tubular housing 12 however, other means may be employed, such as external means, to restrain the piston 26 from rotating. Suitable seals, such as O-rings 54, are provided in the bore 68 to prevent fluid communication between the opposite sides of the piston 26.

The end cover 16 is comprised of two sections, an inner block 70 in which the passageway 60 and fluid port 62 are located, and an outer block 72 in which a rotary actuator 74 is located. The inner wall of the inner block 70 engages the outer end of the tubular housing 12, while the inner wall of the outer block 72 engages the outer wall of the inner block 70 when the elongated bolts 19 are secured by the nuts 20. Suitable sealing means, such as an O-ring 76, disposed in an annular recess 78 in the inner wall of the outer block 72, forms a fluid seal between the juncture of the inner and outer blocks.

The inner block 70 has a centrally disposed bore 80 that is axially aligned with the piston 26 and the actuating rod 38. The unthreaded portion of the shafts 57 extends through the bore 80 and is rotatably supported by a radial-thrust bearing 82 which, in turn, is mounted in a recess 84 in the outer wall of the inner block 70. The bearing 82 is in abutment with shoulder 86 on the shaft 57 to receive axial loads imposed in a leafwardly direction, as viewed in FIG. 1. An O-ring 88, disposed in an annular recess 90 circumscribing the shaft 57, provides a suitable seal to prevent leakage from the extending chamber 28. Referring to both FIGS. 1 and 2, the shaft 57 is shown as having a radially enlarged section 92 with a pair of spline sections 94 that are adapted to engage enlarged diametrically opposed slots 95 in a rotor 96 for rotation therewith about the axis of the shaft 57. The end of the shaft 57 is rotatably supported by a second radial-thrust bearing 98 which is disposed in a blind recess 100 in the outer block 72. The bearing 98 is in abutment with a shoulder 102 on the enlarged section 92 and is adapted to receive axial loads transmitted through the shaft 57, that is, those forces imposed in a rightwardly direction, as viewed in FIG. 1.

Figure 2:
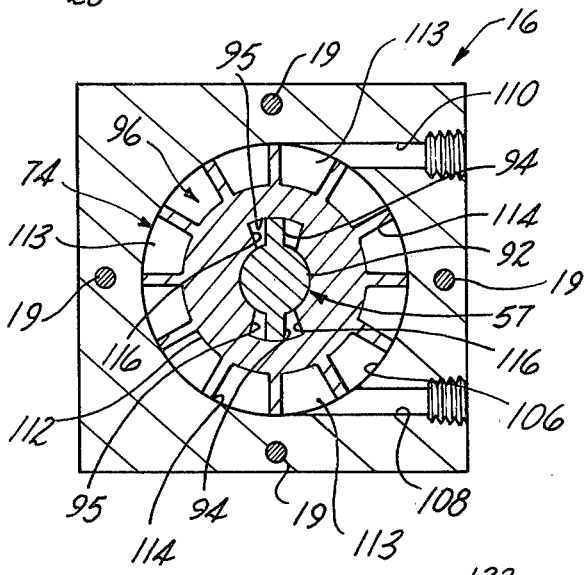
FIG. 2 is a transverse cross-sectional view of the fluid cylinder taken along line 2—2 of FIG. 1.

The rotor 96 is adapted to rotate in a cup-shaped recess 104 in the inner wall of the outer block 72 which in conjunction with the adjacent wall of the inner block 70 forms a circular chamber 106 having tangentially disposed fluid ports 108 and 110 (FIG. 2). Although not shown, a small clearance is provided between the opposite outer sides of the rotor 96 and their respective opposing faces of the block 70 and 72. The rotor 96 has aa peripheral recess 112 which is divided into a plurality of sub-chambers 113 by a plurality of vane members 114 carried by the walls defining the rotor recess 112. The vane members 114 may be attached to the rotor 96 by any suitable means such as being integrally formed with the rotor 96, as shown. When fluid under pressure is admitted to each sub-chamber 113 through the fluid port 108, the force of the fluid striking the vane members 114 will cause the rotor 96 to freely rotate in a clockwise direction, as viewed in FIG. 2, until the walls 116 of the rotor slots 95 will impact the spline sections 94. The continued flow of fluid against the vane members 114, in addition to the momentum of the rotor 96, will rotate the shaft 57. As the rotor 96 rotates in a clockwise direction, the fluid is exhausted through the fluid port 110. In the same manner, fluid under pressure admitted to the sub-chambers 113 through the fluid port 110 will cause the rotor and thus shaft 57 to rotate in a counterclockwise direction, as viewed in FIG. 2, while fluid is exhausted through fluid port 108.

It should be noted that any axial loads which are transmitted from the actuating rod 38 and the piston 26 are taken by the bearings 82 and 98 as the shoulders 86 and 102 on the opposite sides of the enlarged section 92 are in an abutting force transmitting relationship with the bearings and not with the rotor 96. Thus, the rotor 96 is not subjected to these axial loads.

The shaft 57 and actuating rod 38 each may be constructed of any suitable material depending upon the desired application, while the mating threaded portions 52 and 54 of the actuating rod 38 and the shaft 57, respectively, may be of any desired configuration. In the preferred embodiment, the threaded portions 52 and 54 are illustrated as having a conventional Unified Thread of a predetermined pressure angle A and a lead angle B. In the present example of the invention, the relationship between the threaded portion 55 of the shaft 57 and the threaded portion 52 of the actuating rod 38 is such that the two mating threaded portions engage in a self-locking manner and thus there can be no axial movement of the piston 26 within the tubular housing 12 when pressure is acting on the piston 26 to move the same as hereinbefore described, unless there is first relative rotational movement between the piston 26 and the shaft 57. Since the piston 26 and the actuating rod 38 are restrained from rotating by the rod 64, the shaft 57 must be rotated to permit axial movement of the piston 26 and rod 38.

In the embodiment illustrated, a self-locking relationship is achieved when the coefficient of friction between the engaged threaded portion 55 of the shaft 57 and the threaded portion 52 of the actuating rod 38 is at least equal to or greater than the product of the cosine of the pressure angle A and the tangent of the lead angle B, that is:

$$\text{Coefficient of Friction} \geq (\cos A)(\text{Tan } B)$$

When this relationship exists, the piston 26 will not reciprocate within the tubular housing 12, irrespective of how much pressure is admitted to either the extending or retracting chambers 28 and 30, until the shaft 57 is rotated relative to the actuating rod 38 and the piston 26.

Figure 3:
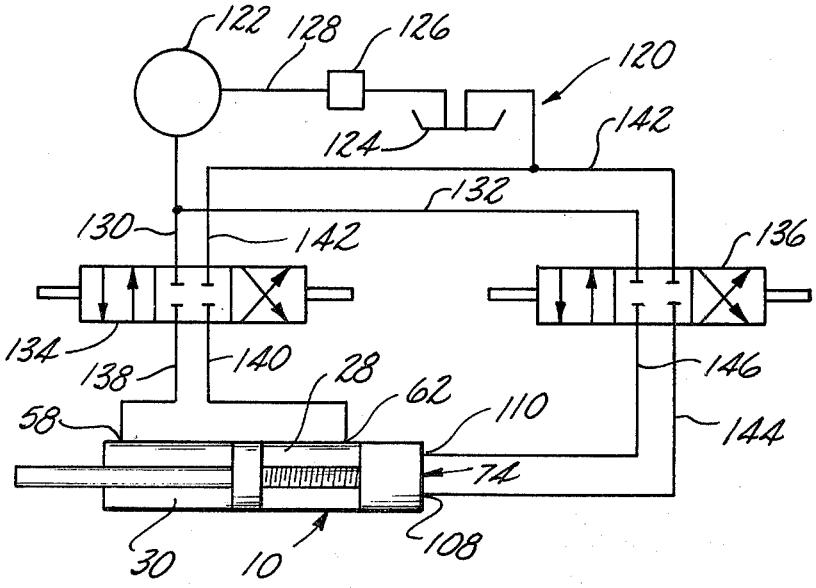
FIG. 3 is a schematic circuit diagram of a fluid system adapted to be used in conjunction with the present invention.

Referring to FIG. 3, there is illustrated a schematic circuit diagram of a preferred hydraulic system 120 adapted for particular use with the present invention and comprising a pump 122 adapted to draw fluid from a reservoir 124 through a fluid filter 126 and a conduit 128. The pump 122 directs pressurized fluid through conduits 130 and 132 to a pair of conventional solenoid actuated directional control valves 134 and 136, respectively. The control valve 134 is adapted to selectively direct fluid under pressure to one of the fluid ports 58 or 62 on the opposite sides of the fluid cylinder 10 through conduits 138 and 140, respectively, for selectively pressurizing either the retracting chamber 30 or the extending chamber 28 to thereby cause reciprocation of the piston 26 as hereinbefore explained. An exhaust conduit 142, connected to the valve 134, communicates the unpressurized chamber to the reservoir 124. At the same time the second control valve 136 may selectively direct fluid under pressure from pump 122 to one of the fluid ports 108 or 110 of the rotary actuator 74 through conduits 144 or 146, while fluid being discharged from the other port 108 or 110 of the actuator 74 is exhausted through exhaust conduit 142.

In operation, when extension of the actuating rod 38 is desired, pressure fluid is directed through fluid port 62 to the extending chamber 28, while simultaneously pressure fluid is directed to the fluid port 110 of the rotary actuator 74 so as to rotate the shaft 57 in a counterclockwise direction (as viewed in FIG. 2). In normal operation, the rate at which the shaft 57 is rotated determines the speed at which the piston 26 will traverse within the tubular housing 12; however, it is the pressure within chamber 28 acting on the piston 26 that determines the force imparted to the load. Although, the main purpose for rotating the shaft 57 is to permit axial movement of the piston 26, the shaft 57 does provide an additional force to aid in the movement of the piston 26. When it is desired to retract the piston 26, the positions of directional control valves 134 and 136 are reversed to direct pressure fluid through fluid port 58 to the retracting chamber 30 and to the fluid port 108, respectively, to exert a force on piston 26 to move the same rightwardly as the rotary actuator 74 is rotated in an opposite direction, that is, in a clockwise direction as viewed in FIG. 2.

It will be noted that although the preferred embodiment illustrates an impulse type rotary actuator 74 for causing relative rotational movement between the threaded portions 52 and 55 of the actuating rod 38 and the shaft 57 respectively, other actuators, such as a gear motor, a helical spline or a piston-rack actuator, may be employed to accomplish the same results.

It can also be seen that at any time during the movement of the piston 26 with respect to the tubular housing 12 a cessation in the flow of the pressure fluid to the rotary actuator 74 will immediately stop the movement of the piston 26 as the piston cannot move due to the locking relationship between the engaged mating threaded portions 52 and 55. In addition to the capability of stopping the piston 26 at any point along its path of movement between an extended and a retracted position, the need for a cushion, as is typical in such fluid cylinders, is not required as the locking engagement between the piston 26 and the shaft 57 can function in place of a cushion to prevent impact of the the piston 26 with the end covers 14 and 16.

It should also be noted that a cessation in the movement of the piston 26 as produced by the non-rotation of the shaft 57 prevents the piston 26 from moving irrespective of the amount of pressure generated in either of the retracting or extending chambers, and thus the piston 26 can be restrained against axial movement without any external source of power being applied to the shaft 57.

In the event of a failure in the system 120, either because of a blow-out across the piston 26 between the retracting and extending chambers or a failure in the conduits connecting the chambers to the pump 122, the piston 26 may be immediately stopped in position and the load restrained against further movement by closing communication between the rotary actuator 74 and the pump 122, and thus a safety mechanism is provided.

In the event of such a failure, it should be further noted that the rotary actuator 74 can function to reciprocate the actuating rod 38 even though the retracting and extending chambers are not functional, in that the rotary actuator 74 has the capacity to impart a reciprocal movement to the actuating rod 38 through the engagement of the threaded portions 52 and 55.

In the event of a system failure with respect to supplying pressure fluid to the rotary actuator 74, such as a failure of pump 122, the rotary actuator 74 will not rotate and thus the piston 26 is restrained from axial movement by the locking engagement between the threaded surfaces 52 and 55. In this condition, the external load will be prevented from moving.

It can thus be seen that the present invention has provided a new and improved fluid cylinder which is simple in its construction; which functions as a safety lock in the event of a pressure failure without the need of an external power source, and is adapted to function as a back-up system to provide a driving force for the fluid cylinder.

What is claimed is as follows:

1. A fluid pressure operated actuator comprising:

a tubular housing having an internal bore enclosed at its opposite ends;

piston means axially reciprocally disposed in said tubular housing bore and dividing said bore into two pressure chambers;

means for communicating pressure fluid to one of said pressure chambers while exhausting the other of said pressure chambers to move said piston means in one direction in said tubular housing bore;

an actuating rod carried by said piston means and extending from one side of said piston means through one enclosed end of said tubular housing;

a member extending from the opposite side of said piston means and rotatably supported in the other enclosed end of said tubular housing, said member having a threaded portion engaging a mating threaded portion carried by said actuating rod, the engaging threaded portion carried by said actuating rod and the threaded portion of said member being in a self-locking relationship such that said piston means is axially movable only when said one pressure chamber is communicated to said pressure fluid and said member is rotated relative to said piston means;

non-locking means operable upon actuation for rotating said member relative to said piston means, said non-locking means being carried by said other enclosed end of said tubular housing; and means coupling said non-locking means to said member such that said non-locking means and said member are rotatable together after a limited amount of independent rotational movement of said non-locking means relative to said member, said non-locking means being coupled to said member in such a manner that said non-locking means does not restrain said member from rotating relative to said piston means whereby the rate of movement of said piston means is controlled by the rate of rotational movement of said member and the force exerted by said piston means and movement thereof is a function of the pressure in said chambers.

2. The fluid pressure operated actuator defined in claim 1 wherein the product of a cosine of the pressure angle of said member and the tangent of the lead angle of the member is equal to or greater than the coefficient of friction of said engaged threaded portions.

3. The fluid pressure operated actuator defined in claim 1 further comprising means for preventing relative rotation between said piston means and said tubular housing.

4. The fluid pressure operated actuator defined in claim 1 wherein said actuating rod extends from one side of said piston means; and said threaded portion of said actuating rod comprises a bore opening to the other side of said piston means in coaxial alignment with said actuating rod, a portion of said bore being threaded a selected distance, said rotatably supported member being in axial alignment with said last mentioned bore and engaged therein.

5. The fluid pressure operated actuator defined in claim 4 wherein the product of the cosine of the pressure angle of the member and the tangent of the lead angle of the member is equal to or greater than the coefficient of friction of said engaged threaded portions.

6. The fluid pressure operated actuator defined in claim 1, wherein said actuating rod threaded portion is a threaded blind bore, said threaded portion of said member extending into said actuating rod blind bore and threadedly engaging same, said one pressure chamber being disposed between said piston means and said outer enclosed end of said housing, and passage means in said member for fluidly connecting said one pressure chamber to the blind end of said actuating blind bore for generating a force against the extended end of said member and said blink end of said blind bore tending to separate said member and said actuating rod.

7. The fluid pressure operated actuator defined in claim 1 wherein said non-locking means is accelerated to such a speed during said limited amount of rotational movement as to gain sufficient momentum such that upon impact of said non-locking means with said member, said member is rotated with said non-locking means.

* * * * *